US007684726B2

(12) United States Patent
Suzuki et al.

(10) Patent No.: US 7,684,726 B2
(45) Date of Patent: Mar. 23, 2010

(54) IMAGE FORMING APPARATUS HAVING THE OUTER COVER INCLUDING ACOUSTIC INSULATION AND HEAT CONDUCTIVE LAYERS

(75) Inventors: Takayuki Suzuki, Kashiwa (JP); Hiroshige Inoue, Abiko (JP); Yuichi Makino, Abiko (JP); Daisuke Kawaguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 11/745,057

(22) Filed: May 7, 2007

(65) Prior Publication Data

US 2007/0292180 A1 Dec. 20, 2007

(30) Foreign Application Priority Data

May 26, 2006 (JP) ..... 2006-146044

(51) Int. Cl.
*G03G 15/00* (2006.01)

(52) U.S. Cl. ..... 399/107; 399/91; 181/283

(58) Field of Classification Search ..... 399/107
See application file for complete search history.

(56) References Cited

U.S. PATENT DOCUMENTS

| | | | | |
|---|---|---|---|---|
| 5,543,904 | A | 8/1996 | Kato et al. | 355/285 |
| 5,999,760 | A | 12/1999 | Suzuki et al. | 399/45 |
| 6,088,567 | A | 7/2000 | Miyashiro et al. | 399/400 |
| 6,950,616 | B2 | 9/2005 | Saito et al. | 399/69 |
| 2006/0029417 | A1 * | 2/2006 | Kawamata et al. | 399/91 |

FOREIGN PATENT DOCUMENTS

| | | |
|---|---|---|
| JP | 6-34955 | 5/1994 |
| JP | 6-348079 | 12/1994 |
| JP | 11-109976 | 4/1999 |
| JP | 11-324707 | 11/1999 |

* cited by examiner

*Primary Examiner*—David M Gray
*Assistant Examiner*—Roy Yi
(74) *Attorney, Agent, or Firm*—Fitzpatrick, Cella, Harper & Scinto

(57) ABSTRACT

An image forming apparatus includes a fixing device for fixing a toner image formed on a recording material by heat and an outer cover, and the outer cover is configured to be the multi-layer of an intermediate layer having a metal made wall and an acoustic absorption member for absorbing a sound, and the intermediate layer is provided with the outer cover configured to have an heat conductive member higher in heat conductivity than the acoustic absorption member.

2 Claims, 4 Drawing Sheets

IMAGE FORMING APPARATUS HAVING THE OUTER COVER INCLUDING ACOUSTIC INSULATION AND HEAT CONDUCTIVE LAYERS

BACKGROUND OF THE INVENTION

1. Field of the Invention

The present invention relates to an outer member of a multi-layer structure having an acoustic insulation layer and an image forming apparatus having a heat source inside the apparatus.

2. Description of the Related Art

In general, an image forming apparatus such as a copying machine uses parts such as a laser scanner, motor, solenoid, and clutch, which intermittently or stationarily operate at the image forming time. These parts generate noise in no small way at the operating time. Further, these parts often cause surrounding parts to resonate and generate the noise by not only the noise generated by them, but also the vibration generated by these parts. Further, though the image forming apparatus coveys a sheet such as a recording material, when the sheet is conveyed, the noise is also generated by rubbing, buckling, thrusting and the like of the sheet. Hence, to meet the situation, measures have been taken so far to reduce the noise by suppressing the noise generated inside the apparatus or preventing the noise generated inside the apparatus from leaking to the outside of the apparatus.

The measures to prevent the noise from leaking to the outside of the apparatus are usually taken by outer covers. The sound traveling to the outside of the apparatus includes the leaked sound leaking from the seams between the outer covers and louvers or the like, and the transmitted sound transmitting the outer covers. Usually, with respect to the leaked sound, there is a method for dealing with the situation by filling in the seams of the outer covers. On the other hands, with respect to the transmitted sound, it is known that an acoustic insulating effect of the outer cover of the multi-layer structure which alternately laminates solid layers and air layers is high. Sound waves generated inside the apparatus transmit through the air taken as an intermediary. However, when the solid layer such as the outer cover is interposed, impedance astronomically changes on the boundary surface between gas and one of liquid and solid. Hence, in that boundary surface, the energy of the sound is reflected approximately 100%, and hardly enters ahead of the boundary surface in the form of sound waves. In other words, the sound transmitting the outer cover which is audible outward is generated in such a way that the solid layer of the outer cover is vibrated by the mechanical force carried by the sound wave, and by that vibration, the air layer at the opposite side is vibrated. Here, when the transmitted sound transmits the solid layer, a transmission loss according to the type of the solid layer is generated. This transmission loss has nothing to do with the material of the solid layer, but is decided by its mass only. Hence, if the material high in density is used, the sound transmitting the solid layer is attenuated, and the energy which vibrates the air layer at the opposite side is also attenuated, so that the transmitted sound becomes small. Further, even when a porous acoustic insulation material is used for the solid layer, the transmitted sound becomes small. For this reason, according to the disclosure in Japanese Patent Application Laid-Open No. H06-348079, the outer cover of the multi-layer structure uses a sheet metal and resin for the inner wall and the outer wall to enhance the acoustic insulating effect, and uses the air layer and the acoustic insulation material for an intermediate layer between the two walls. Further, according to the disclosure in Japanese Patent Application Laid-Open No. H11-109976, there is a configuration in which, similarly as the acoustic insulation measures, a vacuum layer is formed between the outer wall and the inner wall so as to shut off the noise, and according to the disclosure in Japanese Patent Application Laid-Open No. H11-324707, there is a configuration in which the sound of the diesel engine is shut off by a sound-insulation cover material which is layer-formed of the acoustic insulation material and the sound-insulation material between a structural material (outer wall) and a diffusely reflecting material (inner wall).

As described above, since the outer cover of the multi-layer structure is high in sound-insulation effect, it is extremely effective as acoustic insulation measures. At the same time, however, the air layer and the acoustic insulation material serve as heat-insulation materials. While the image forming apparatus has a heating body such as a fixing device and a power source, an unnecessary heat must be discharged into the outside of the apparatus. Usually, the heat discharge is performed by forced heat discharge using a cooling fan and natural heat dissipation from the outer cover surface and the like. Since the outer cover of the multi-layer structure, as described above, performs the acoustic insulation as well as the heat insulation, the natural heat dissipation from the outer cover surface cannot be expected. To compensate for this heat discharge portion by the natural heat dissipation from the outer cover surface, it is conceivable to enhance a forced heat discharge capacity by using a cooling fan. To enhance the forced heat discharge capacity by using the cooling fan, there are methods for enlarging the size of the fan, increasing the number of rotations of the fan, enlarging the opening portion of the outer cover such as the louvers, and the like. However, in these methods, there is a possibility that the acoustic insulation effect by the above described outer cover is reduced. Further, though Japanese Utility Model Application Laid-Open No. 6-34955 discloses a configuration in which a heat conductive member is provided in a part of the outer cover, the provision of the heat conductive member in a part of the cover only is not enough for heat dissipation inside the apparatus, and the heat is liable to be accumulated at a position distant from the heat conductive member.

SUMMARY OF THE INVENTION

An object of the present invention is to suppress a temperature rise inside the apparatus, while maintaining an acoustic insulation effect by the outside cover of a multi-layer structure.

Another object of the present invention is to provide an outer cover attached to an image forming apparatus including a fixing unit for fixing a toner image formed on a recording material by heat; and an acoustic insulation member for preventing a sound, a heat conductive member higher in coefficient of heat conductance than the acoustic insulation member, and a surface layer covering the acoustic insulation member.

A further object of the present invention will be apparent from the following detailed description and the accompanying drawings.

A still further object of the present invention will become apparent from the following description of exemplary embodiments with reference to the attached drawings.

DESCRIPTION OF THE EMBODIMENTS

Exemplary embodiments of the present invention will be described below in detail with reference to the drawings. However, it should be understood that the size, material, shape, and relative layout of the component parts described in the following embodiments are suitably changed according to the configuration and various conditions of the apparatus applied by the present invention. Consequently, unless specifically described otherwise, the scope of the present invention is not limited to those only as described above.

First Embodiment

By using FIGS. 1 to 3, an image forming apparatus according to a first embodiment will be described. First, by using FIG. 2, a schematic configuration of the image forming apparatus will be simply described, and then, by using FIGS. 1 and 3, an outer member in the image forming apparatus will be described in detail.

Figure 2:
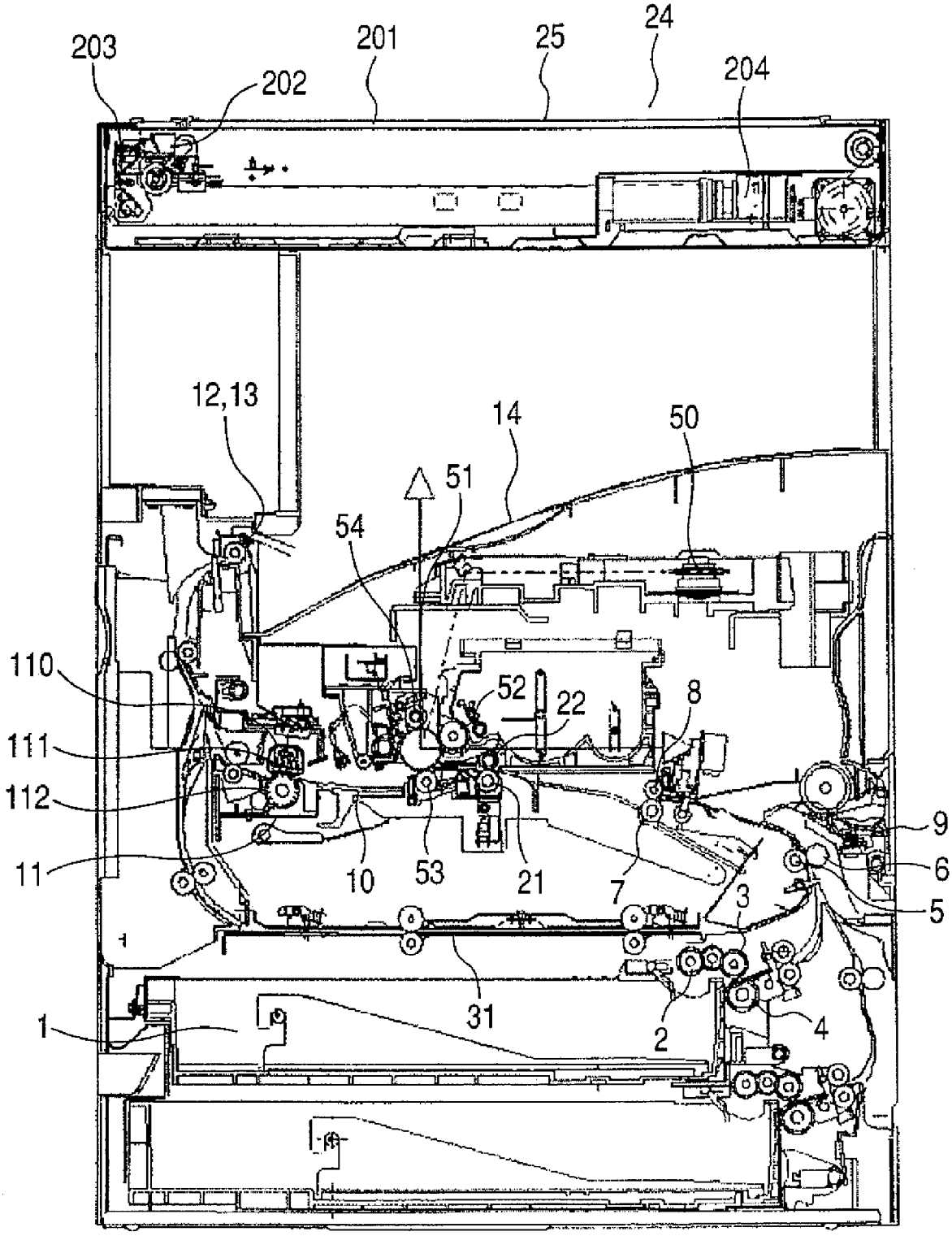
FIG. 2 is a main cross-sectional view of an image forming apparatus having an outer cover of a multi-layer structure.
Figure 3:
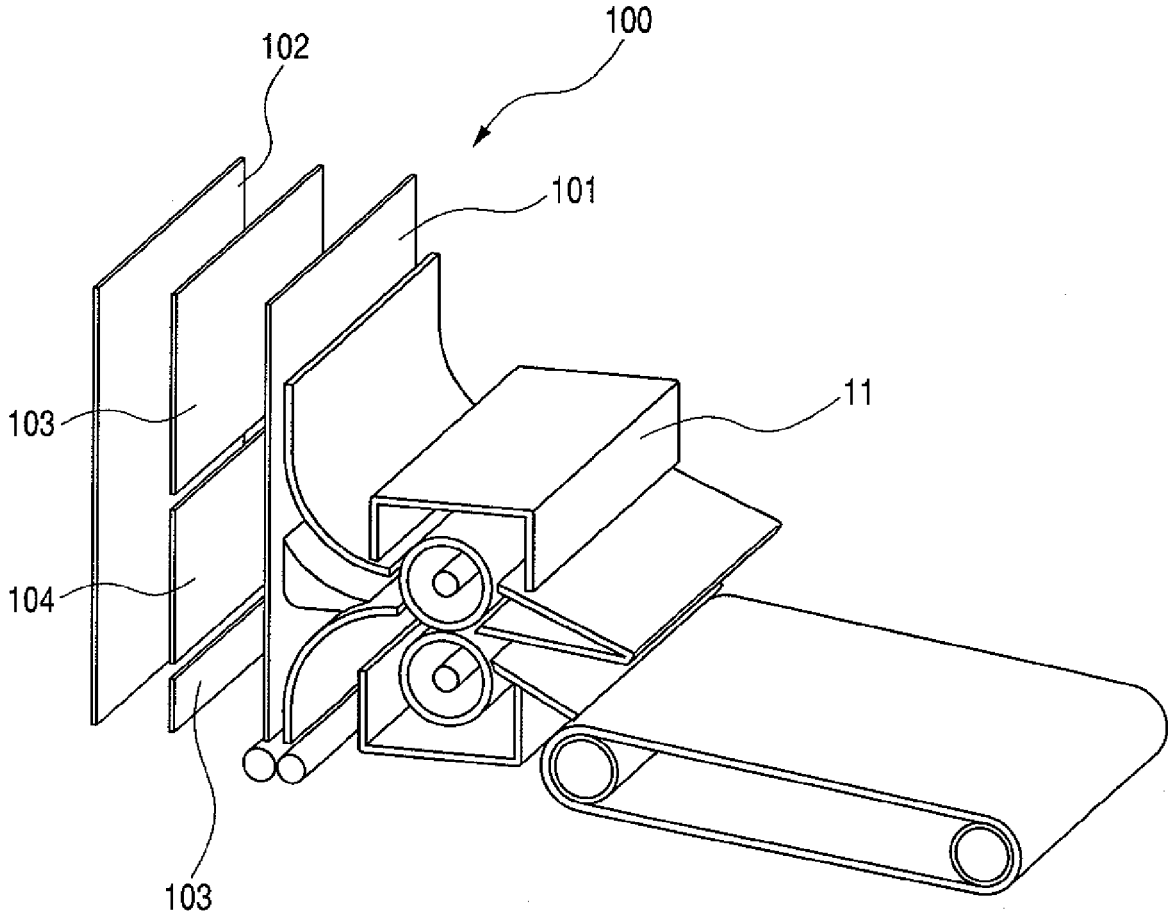
FIG. 3 is an oblique development illustrating one example of the layout of the outer cover and a heat source.

In FIG. 2, a copying machine is illustrated as the image forming apparatus. As shown in FIG. 2, when an user sets an original on an original glass 201 and depresses a copying button, an exposure device 202 moves in a direction to an arrow mark a and scans the entire surface of the original, while irradiating the original. The light having irradiated the original by the exposure device 202 is turned back by second and third mirrors 203, and forms an image on a CCD 204 by lens. The information on the original read by the CCD 204 is converted into an electric signal in an image processing unit, and is transmitted to a laser scanner 50 which is an image exposure device. A photosensitive drum which is an image bearing member including an image forming portion is charged by a charge member 54. The laser beam corresponding to the image information emitted from the laser scanner 50 scans the charged photosensitive drum 51 so as to form an image, thereby forming an electrostatic latent image on the surface of the photosensitive drum 51. This electrostatic latent image is developed by a developing device 52. Consequently, the photosensitive drum 51 is formed with a toner image.

Recording materials are set to a sheet feeding cassette 1 and stored inside a photo copying machine main body 25. When the sheet feeding cassette 1 is set inside the main body, the recording materials ascend inside the sheet feeding cassette 1 by an unillustrated lifter motor, and are put into a state of capable of feeding the sheet. The recording materials start moving by the rotation of a sheet feeding roller 2, and are separated one by one by a pair of separating rollers 3 and 4, and are conveyed to a pair of registration rollers 7 and 8 through a pair of upstream side conveying rollers 5 and 6, and a conveying path 9.

The recording materials compensated for registration by the pair of registration rollers 7 and 8 are conveyed to an image forming portion by a pair of conveying rollers 21 and 22, and the toner image already developed by the developing device 52 is transferred between the photosensitive drum 51 and a transfer roller 53 which is a transfer member. The recording materials conveyed to the image forming portion have the passing through of the recording materials detected by an unillustrated recording material passing through detection device, and are timely fed to the image forming portion aligned with a position of the toner image.

The recording material transferred with the toner image is peeled off from the photosensitive drum 51, and is fed to a fixing device 11 which is a fixing unit for fixing the toner image on the recording material by heat through a conveying path 10. In the present embodiment, the fixing device is configured to be a unit detachably attachable with the image forming apparatus. The recording material is fixed with the toner image by heat in the fixing device 11, and is discharged to the outside of the apparatus by a pair of sheet discharging rollers 12 and 13, and is loaded on a sheet discharging tray 14. As a result, a copying machine 24 completes a one side copying operation of the recording material. When images are formed on both sides of the recording material, the recording material coming out of the fixing device 11 is put on a switch back conveyance, and after that, passes through a reversal path 31, and is fed again to the image forming portion. The recording material is formed with an image on the opposite surface in the image forming portion. The subsequent operation is the same as the one side copying operation. The configuration of the fixing unit will be simply described. A fixing film 110 (fixing belt) which is a fixing member contacting the toner image before fixed on the recording material is provided. The inner surface of the fixing film is provided with a heater 111 which is a heat-generating member. The heater is provided with a control unit for controlling an amount of electricity supplied to the heater according to an output of the temperature detection member for detecting the temperature of the heater. By this control unit, the temperature of the heater is controlled. Further, a pressing roller 112 is provided, which is a pressing member for pinching and conveying the recording material by contacting the fixing film.

Next, an outer cover as an outer member in the image forming apparatus will be described in detail.

The outer cover is usually installed on all five surfaces of four side surfaces and one upper surface except for the bottom of the image forming apparatus. Further, the outer cover is suitably split to be suited for the processing when the recording materials are piled up inside the apparatus or to be suited to feed consumables such as toner and recording materials.

In the present embodiment, the outer cover of a multi-layer structure in which a metal layer serving as a surface layer or a resin layer and an acoustic insulation layer are alternately laminated is adopted for all the five surfaces. Specifically, as shown in FIG. 1, the outer cover 100 of the multi-layer structure uses an inner wall 101 and an outer wall 102 formed of a sheet metal as a metal layer, and an intermediate layer 103 between these two walls 101 and 102 uses an acoustic insulation material as an acoustic insulation layer.

Incidentally, the metal layer is a layer formed of metal, and it is not limited to the sheet metal nor is it limited to the metal layer, and it may be a layer (resin layer) formed of resin.

Here, the acoustic insulation material used for the intermediate layer 103 has acoustic absorbing qualities for absorbing a sound, and at the same time, in many cases, has adiabaticity. Hence, when the outer cover 100 of the multi-layer structure is used in the vicinity of a heat-generating body (heat source) such as the fixing device 11 and the power source (not shown), the natural heat dissipation from the outer cover surface (surface of the outer wall 102) can be hardly expected. Therefore, in the vicinity of such a heat-generating body, a forced heat discharge must be performed by more assertively using a cooling unit such as a fan. However, since the forced heat discharge by using the fan generates the noise of the fan itself and a leaked sound from the opening for the heat discharge, the acoustic insulation effect is reduced.

Figure 1:
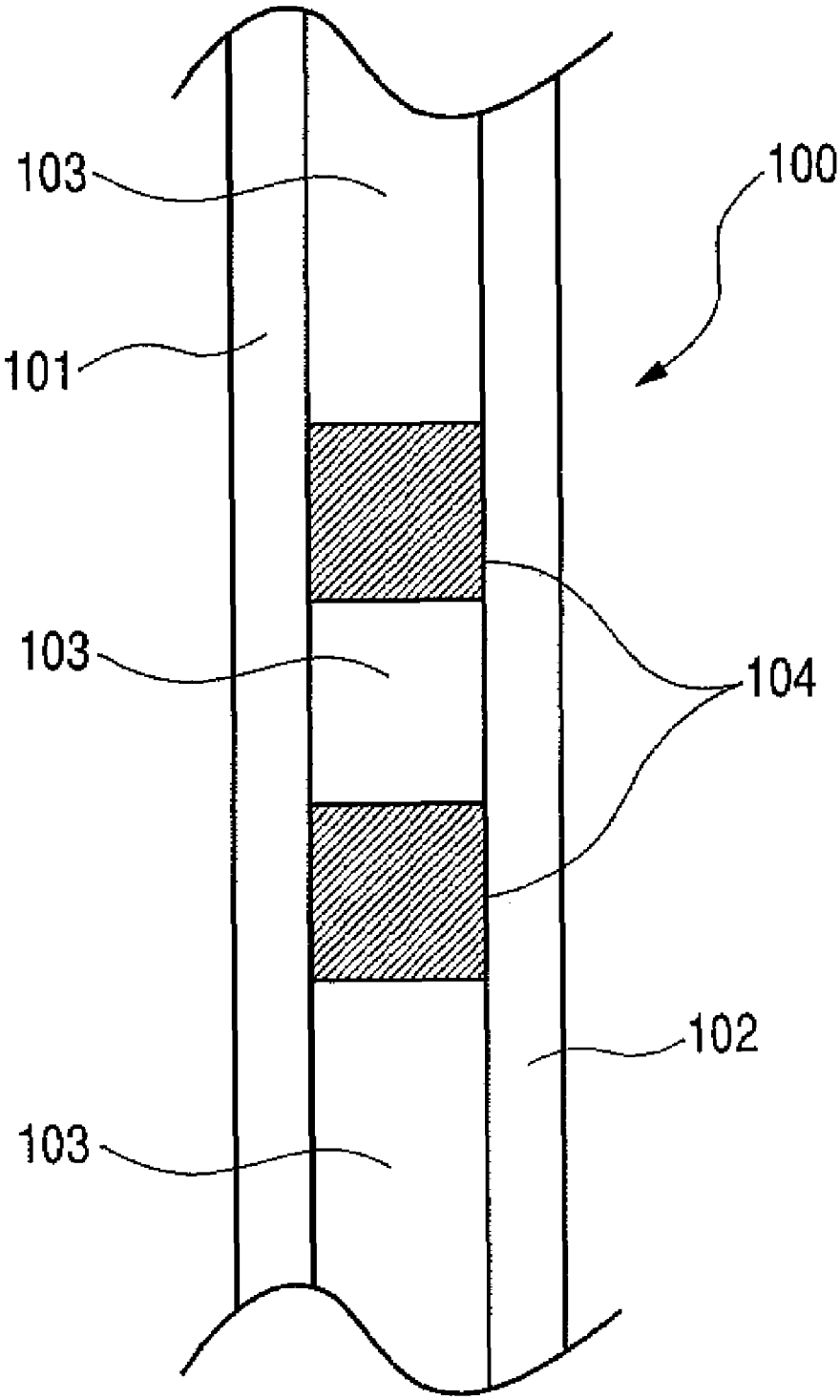
FIG. 1 is a schematic cross-sectional view illustrating an outer cover of a multi-layer structure.
Figure 4:
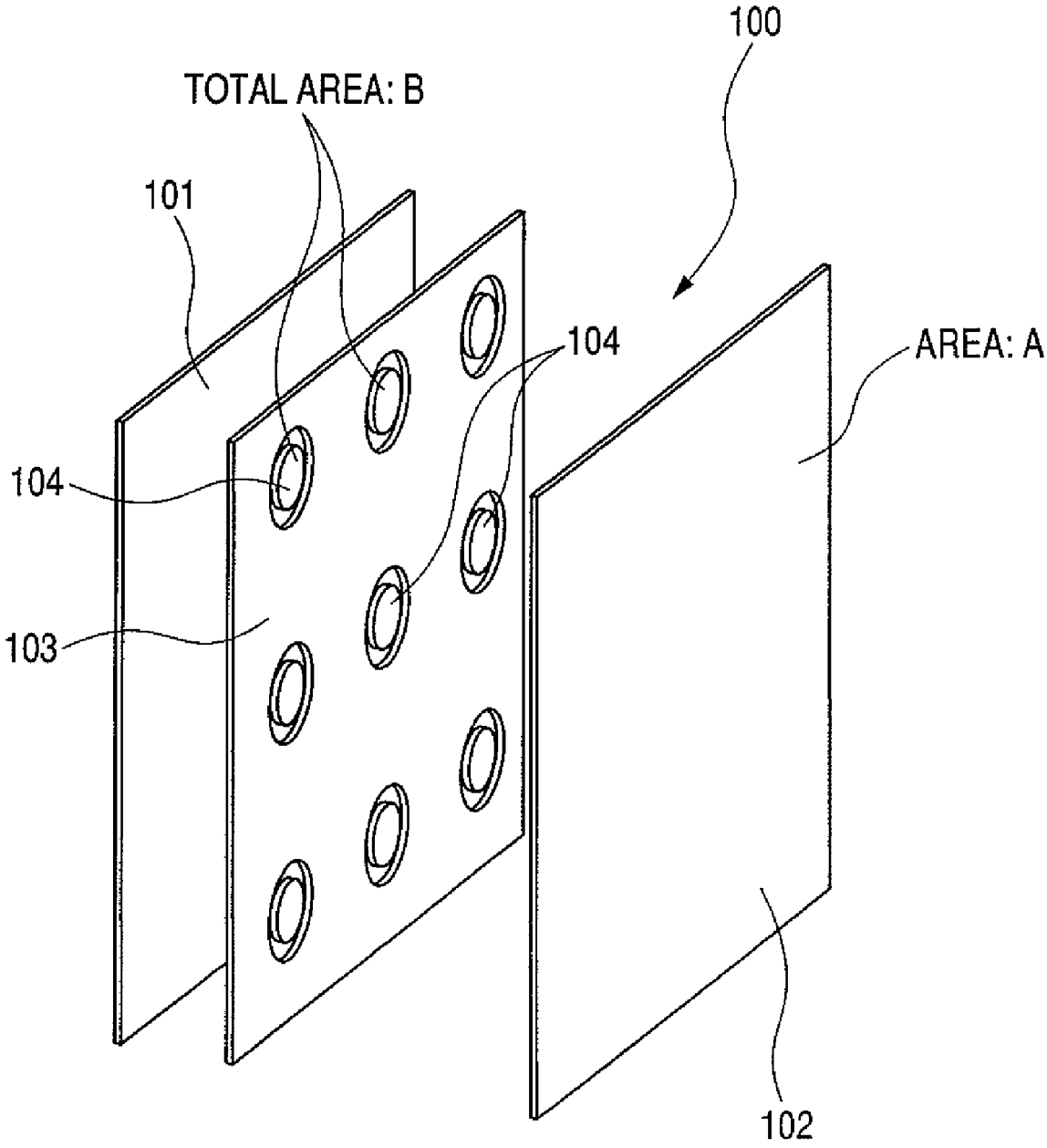
FIG. 4 is an oblique development illustrating another example of the outer cover.

Hence, in the present embodiment, as shown in FIGS. 1 and 4, the outer cover 100 disposed on a projection surface of the heat source has a heat conductive member 104 for conducting the heat from the heat source to the outer wall 102. That is, the outer cover 100 has a large area opposed to the fixing unit or it is a side plate 100 in the conveying direction side of the recording material for the fixing unit. Specifically, as shown in FIG. 3, the outer cover 100 positioned close to the fixing device 11 (projection surface in a horizontal direction) as the heat-generating body partially disposes the heat conductive member 104 in the intermediate layer 103. This heat conductive member 104 is partially disposed in the intermediate layer 103 so as to contact the inner wall 101 and the outer wall 102. Incidentally, the air inside the apparatus warmed up by the heat-generating body is accumulated upward from the horizontal direction of the heat-generating body. As a result, the projection surface of the heat-generating body includes not only the projection surface in the horizontal direction, but also the portion above the projection surface in the horizontal direction of the heat-generating body or the projection surface in the vertical direction of the heat-generating body. The intermediate layer 103 of the outer cover 100 disposed on at least one of these projection surfaces is partially provided with the heat conductive member 104. The description thereof will be made below in more detail.

The outer cover of the conventional image forming apparatus, in many cases, is not the outer cover of the above described multi-layer structure, but adopts the outer cover of a single layer structure formed of resin such as ABS. There are many resins such as ABS whose coefficient of heat conductance is about 0.2 ($W \cdot m^{-1} \cdot K^{-1}$). In contrast to this, the acoustic insulation material used for the intermediate layer 103 of the outer cover of the multi-layer structure often uses a foam material such as polyurethane and polyethylene. The coefficient of heat conductance of these foam materials is about 0.02 ($W \cdot m^{-1} \cdot K^{-1}$), and it is about 1/10 as compared with the coefficient of heat conduction of resin, so that the intermediate layer 103 ends up operating as the heat insulation layer. In contrast to this, the coefficient of heat conductance of the metal including the inner wall and the outer wall is about 200 ($W \cdot m^{-1} \cdot K^{-1}$) in the case of aluminum, and about 45 ($W \cdot m^{-1} \cdot K^{-1}$) in the case of iron. As the acoustic insulation material, in addition to the above described, a thin fiber such as glass wool and rock wool molded in the shape of a plate may be used.

Here, it is known that a heat quantity discharged from the inside of the apparatus to the outside of the apparatus through the outer cover has the following relational formula (1) established according to Fourier's law, assuming that a heat quantity is taken as Q(J), a coefficient of heat conductance as k(W/·m·K), a temperature at the high temperature side as Th(K), a temperature at the low temperature side as Tl(K), a contact area as A($m^2$), a thickness of the outer cover as a(m), and a time as t(s).

Formula 1

$$Q=k\cdot(Th-Tl)\cdot A\cdot t\cdot a^{-1} \quad (1)$$

That is, assuming that the thickness of the outer cover is the same, the outer cover of the multi-layer structure using the acoustic insulation material is about 1/10 in coefficient of heat conduction compared with the conventional resin made outer cover of the signal layer structure, and therefore, it is apparently ten times inferior to the conventional outer cover in heat dissipation effect.

Hence, the present embodiment is configured as follows so as to maintain the acoustic insulation effect by the outer cover of the multi-layer structure and obtain the natural heat dissipation effect equal to or more than that of the resin made outer cover.

The air inside the apparatus warmed up by the heat source such as the fixing device 11 is accumulated upward from the horizontal direction of the heat source. Hence, the projection surface in the horizontal direction from the heat source or the upper portion from the projection surface in the horizontal direction of the heat source or the outer cover 100 disposed on at least one of the projection surfaces in the vertical direction of the heat source is partially provided with a plurality of heat conductive members 104 as shown in FIG. 1. This heat conductive member 104 is configured to penetrate the acoustic insulation material, and is configured to contact the inner wall and the outer wall so as to enhance heat conductivity from the inner wall to the outer wall.

From the Fourier's law, the following relational formula (2) is established assuming that a projection area of the projection surface of the heat source in the outer cover is taken as A($m^2$), a total area of a plurality of heat conductive members as B($m^2$), and a coefficient of heat conductance of the heat conductive member as k.

The heat quantity in the case of the resin cover of the single layer becomes Ql=kl(Th−Tl)Ata^(−1). Considering it is the resin single layer cover, kl=0.2. In contrast to this, the present invention enhances the heat conductivity much more when using the acoustic insulation member having the same thickness. That is, the heat quantity Q2 of the present invention becomes as follows.

$$Q2=k2(Th-Tl)Bta\hat{}(-1)+k3(Th-Tl)(A-B)ta\hat{}(-1)$$

The thickness of the acoustic insulation layer at this time is assumed to be the same as before. Here, as for the acoustic insulation member, since k3=0.02, its value is input.

As a result, while the acoustic insulation properties with the same thickness are more excellent than the conventional single layer resin cover, in order to enhance the heat conductivity, the following formula is established.

Formula 2

$$k\cdot B+0.02\cdot(A-B)\geqq 0.2\cdot A \quad (2)$$

(k=k3)

That is, the intermediate layer (acoustic insulation layer) 103 of the outer cover 100 of the multi-layer structure may be disposed with the heat conductive member 104 so as to satisfy the above described formula (2). As a result, even if it is the outer cover of the multi-layer structure, it can obtain the natural heat dissipation effect equal to or more than that of the resin made outer cover, while maintaining its acoustic insulation effect. That is, while maintaining the acoustic insulation effect by the outer cover of the multi-layer structure, the natural heat dissipation effect from the outer cover surface is enhanced, and the heat generated inside the apparatus is effectively dissipated into the outside of the apparatus, so that the temperature rise inside the apparatus can be suppressed.

Further, in the outer cover 100 of the multi-layer structure shown in FIG. 1, compared with the coefficient of heat conductance of the inner wall 101 and the outer wall 102, the coefficient of heat conductance of the intermediate layer 103 (acoustic insulation layer) is about 1/10, and therefore, the heat dissipation effect by this intermediate layer 103 can be hardly expected. Hence, in view of this point, when the formula (2) is further simplified, the following relational formula (3) is established.

Formula 3

$$B\geqq 0.2A/k \quad (3)$$

(k=k3)

Here, compared with the acoustic insulation member, when iron is adapted as the heat conductive member high in coefficient of heat conductance, as described above, since the heat conductivity of iron is about 45 (W·/m·K), the above described formula (3) becomes as follows.

$$B \geqq 0.2 \cdot A/45$$

$$B \geqq 0.004A(\mathrm{m}^2) \qquad \text{Formula 4}$$

Hence, for example, when the inner wall 101 and the outer wall 102 are fastened by using a screw made of iron of about M3 as the heat conductive member 104 so as to conduct the heat through the screw, one or more screws may be disposed in the area of about 42 mm×42 mm of the intermediate layer. As a result, the heat from the heat-generating body can be transferred from the inner wall 101 to the outer wall 102 through the heat conductive member 104 provided in the intermediate layer 103, so that the natural heat dissipation effect from the outer wall 103 can be enhanced. In the present embodiment, the inner wall 101 and the outer wall 102 are assumed to be a metal sheet of 1 mm in thickness, and the thickness of the intermediate layer 103 is assumed to be 2 mm. As against the conventional resin cover of 2 mm to 3 mm in thickness, even if the total thickness is about the same, while the acoustic insulation properties are enhanced, the heat conductivity can be enhanced. That is, even if it is the outer cover of the multi-layer structure, while the acoustic insulation effect is maintained, the heat dissipation effect equal to or more than that of the resin made outer cover of the single layer structure can be expected, and the heat generated inside the apparatus can be effectively dissipated into the outside of the apparatus, and the temperature rise inside the apparatus can be suppressed.

Other Embodiments

In the above described embodiments, while the outer cover of the multi-layer structure located close to the heat-generating body such as the fixing device and the power source has been illustrated so as to show the configuration in which the acoustic insulation layer of this outer cover is disposed with the heat conductive member, the present invention is not limited to this configuration. The configuration may be such that the heat conductive member is exposed from the inner cover or the outer cover.

For example, as shown in FIG. 4, it may be an outer cover having a relatively large area such as a rear surface cover. The acoustic insulation layer of this outer cover may be disposed with a plurality of relatively small heat conductive members 104 spaced at the predetermined interval. Usually, the heat-generating body such as the power source is often disposed at the main body rear surface side, and further, the heat-generating body such as a motor is also often dispersively disposed at the main body rear surface side. Particularly, the motor is not only a heat-generating body, but also a noise source. In such a case, the rear surface cover as the outer member is required to have an acoustic insulation effect and a heat dissipation effect. As described above, the acoustic insulation layer of the rear surface cover is disposed with a plurality of heat conductive members at the predetermined intervals, so that the acoustic insulation effect and the heat dissipation effect can be given to the rear surface cover.

Further, in the above described embodiments, as the outer member of the multi-layer structure laminated with the metal layer or the resin layer and the acoustic insulation layer, while the outer member of the multi-layer structure with the intermediate layer between the metal layers or the resin layers taken as the acoustic insulating layer has been illustrated, the present invention is not limited to this. If it is an outer member of the multi-layer structure laminated with the metal layer or the resin layer and the acoustic insulation layer, it may be an outer member of other multi-layer structure, and for example, it may be an outer member of the multi-layer structure laminated with the acoustic insulating layer at the apparatus inner surface side of the metal layer or the resin layer.

Further, in the above described embodiments, while the metal layer has been illustrated as the heat conductive member having heat conductivity higher than the acoustic insulation layer, the present invention is not limited to this. For example, it may be the heat dissipation member (coefficient of heat conductance is about 1 to 5 (W/m·K) such as silicon and heat conductivity grease used for the heat dissipation of electrical parts.

Further, in the above described embodiments, while the heat-generating body such as the fixing device, the power source, and the motor has been illustrated as the heat source, the present invention is not limited to these components, and other heat-generating bodies such as a clutch and a solenoid can be conceivable. By applying the present invention to the outer member of the multi-layer structure located close to these heat-generating bodies, the same effect can be expected.

As described above, while maintaining the acoustic insulation effect by the outer cover of the multi-layer structure by the present invention, the natural heat dissipation from the outer cover surface is enhanced, and the heat generated inside the apparatus is effectively dissipated into the outside of the apparatus, so that the temperature rise inside the apparatus can be suppressed.

Although the embodiments of the present invention have been thus described, it is to be expressly understood that the present invention is not limited to the above described embodiments in any case, and many modifications and variations would present themselves without departing from the scope and spirit of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-146044, filed May 26, 2006, which is hereby incorporated by reference herein in its entirety.

What is claimed is:

1. An image forming apparatus comprising:

a fixing unit for fixing a toner image formed on a recording material by heat; and an outer cover attached to the image forming apparatus, including an acoustic insulation member for preventing a sound and a heat conductive member having a coefficient of heat conductance higher than the acoustic insulation member and a surface layer covering the acoustic insulation member, wherein the heat conductive member is metal.

2. An image forming apparatus comprising:

a fixing unit for fixing a toner image formed on a recording material by heat; and an outer cover attached to the image forming apparatus, including an acoustic insulation member for preventing a sound and a heat conductive member having a coefficient of heat conductance higher than the acoustic insulation member and a surface layer covering the acoustic insulation member, wherein the surface layer is a metal member.

* * * * *